US007908826B2

(12) United States Patent
Reaves et al.

(10) Patent No.: US 7,908,826 B2
(45) Date of Patent: Mar. 22, 2011

(54) METHOD AND APPARATUS FOR PROVIDING END SEALS ON VERTICAL STAND-UP PACKAGES

(75) Inventors: Jerry Mike Reaves, Midlothian, TX (US); Jeryl Edwin White, Hurst, TX (US)

(73) Assignee: Frito-Lay North America, Inc., Plano, TX (US)

( * ) Notice: Subject to any disclaimer, the term of this patent is extended or adjusted under 35 U.S.C. 154(b) by 1122 days.

(21) Appl. No.: 10/987,920

(22) Filed: Nov. 12, 2004

(65) Prior Publication Data

US 2006/0107619 A1 May 25, 2006

(51) Int. Cl.
*B65B 9/00* (2006.01)

(52) U.S. Cl. ..... 53/451; 53/469; 53/551

(58) Field of Classification Search ..... 53/450–452, 53/469, 551–554, 558, 570; 493/248, 440
See application file for complete search history.

(56) References Cited

U.S. PATENT DOCUMENTS

| | | | | | |
|---|---|---|---|---|---|
| 2,265,075 | A * | 12/1941 | Knuetter | 493/197 |
| 2,718,105 | A * | 9/1955 | Ferguson et. al. | 53/548 |
| 3,262,244 | A * | 7/1966 | Cutler et. al. | 53/551 |
| 3,855,907 | A * | 12/1974 | Johnson et al. | 493/235 |
| 4,355,494 | A * | 10/1982 | Tilman | 53/416 |
| 4,532,753 | A * | 8/1985 | Kovacs | 53/451 |
| 4,947,621 | A | 8/1990 | Christine et al. | |
| 4,999,974 | A * | 3/1991 | Kovacs et al. | 53/434 |
| 5,054,270 | A | 10/1991 | McMahon | |
| 5,186,707 | A * | 2/1993 | Barta | 493/439 |
| 5,241,804 | A * | 9/1993 | Tsuruta et al. | 53/504 |
| 5,246,416 | A * | 9/1993 | Demura et al. | 493/439 |
| 5,279,098 | A * | 1/1994 | Fukuda | 53/451 |
| 5,622,033 | A | 4/1997 | Fukuda | |
| 5,753,067 | A * | 5/1998 | Fukuda et al. | 156/358 |
| 5,881,539 | A * | 3/1999 | Fukuda et al. | 53/526 |
| 5,930,983 | A | 8/1999 | Terminella et al. | |
| 6,145,282 | A * | 11/2000 | Tsuruta | 53/551 |
| 6,519,917 | B2 * | 2/2003 | Forman | 53/412 |
| 6,553,744 | B1 | 4/2003 | Terminella et al. | |
| 6,679,034 | B2 | 1/2004 | Kohl et al. | |
| 6,722,106 | B2 | 4/2004 | Bartel et al. | |
| 6,729,109 | B2 | 5/2004 | Knoerzer et al. | |
| 2003/0172624 | A1 * | 9/2003 | Bartel et al. | 53/451 |
| 2003/0172626 | A1 * | 9/2003 | Kohl et al. | 53/451 |

* cited by examiner

*Primary Examiner* — Thanh K Truong
(74) *Attorney, Agent, or Firm* — James R. Gourley; Chad E. Walter; Carstens & Cahoon, LLP

(57) ABSTRACT

An improved method and apparatus for providing end seals on vertical stand up packages that prevents pleat formation and gusset variation. A clamping device is mounted below sealing jaws. A bottom end seal is made by the sealing jaws to form an open-ended tube. The open-ended tube is moved downward. The clamping device engages the tube to prevent twisting when product is placed into the tube. Product then enters an open-ended tube of flexible film packaging and the top seal is made.

7 Claims, 5 Drawing Sheets

118
116
114
114
122
120
120
106
104
126
102
130
126
101
131
L
133
300
112
124
110
131

METHOD AND APPARATUS FOR PROVIDING END SEALS ON VERTICAL STAND-UP PACKAGES

BACKGROUND OF THE INVENTION

1. Technical Field

The present invention relates to a vertical stand-up package made from a modified vertical form, fill, and seal packaging machine, and the apparatus and method for making same, that provides for a single piece construction of a vertical stand-up package. In particular, the invention reduces the pleating that can occur when filling a vertical stand-up package with minimal cost increase and minimal modification.

2. Description of Related Art

Vertical form, fill, and seal packaging machines are commonly used in the snack food industry for forming, filling, and sealing bags of chips and other like products. One such packaging machine is seen diagrammatically in FIG. 1. This drawing is simplified and does not show the cabinet and support structures that typically surround a machine, but it demonstrates the working of the machine well. Packaging film 110 is taken from a roll 112 of film and passed through tensioners 114 that keep it taut. The film then passes over a former 116, which directs the film into a vertical tube around a product delivery cylinder 118. As the tube is pulled downward by drive belts 120 the vertical tube of film is sealed along its length by a vertical sealer 122, forming a back seal 124. The machine then applies a pair of heat sealing jaws 126 against the tube to form a transverse seal. This transverse seal acts as the top seal 133 on the bag 130 below the sealing jaws 126 and the bottom end seal 131 on the bag 132 being formed above the jaws 126. After the transverse seal has been formed, a cut is made across the sealed area to separate the finished bag 130 below the seal from the partially completed bag 132 above the seal. The tube is then pushed downward to draw out another package length. Before the sealing jaws 126 form each transverse seal the product to be packaged is sent through the product delivery cylinder 118 and is held within the tube above the bottom end seal 131. The material that is fed into the form, fill and seal machine is typically a packaging film such as polypropylene, polyester, paper, polyolefin extrusions, adhesive laminates, and other such materials, or from layered combinations of the above. For many food products, where flavor retention is important, a metalized layer will form the inner most layer.

One modification to a vertical form, fill, and seal packaging machine is disclosed in U.S. Pat. No. 6,722,106 ("the '106 Patent"), which is assigned to the same assignee as the present invention. The '106 Patent discloses a method for making a free standing package called a vertical stand up pouch. The modification uses two forming plates 104 and a tension bar 102 to hold the packaging film tube in tension from inside the tube. Tension is applied on the outside of the film and in the opposite direction of the tension provided by the forming plates 104 by a fixed or stationary tucker mechanism 106 positioned between the forming plates 104. The tucker bar 106 provides a crease or fold in the tube of the packaging film between the two forming plates 104. The crease is formed prior to formation of the transverse seal by the seal jaws 126. Consequently, once the transverse seal is formed, the crease becomes an integral feature of one side of the package. The vertical form and fill machine thereafter operates basically as previously described in the prior art, with the sealing jaws 126 forming a lower transverse seal 131, product being introduced through the forming tube 118 into the sealed tube of packaging film which now has a crease on one side, and the upper transverse seal being formed, thereby completing the package. An example of the vertical stand up package formed shown in FIGS. 2*a* and 2*b*, which show the outside layer of packaging film 116 with the graphics oriented 90 degrees clockwise from graphics orientation normally present on a pillow pouch formed by a standard prior art vertical form, fill and seal machine. As shown in FIGS. 2*a* and 2*b* the transverse seals 131, 133 of the vertical stand up package are oriented vertically once the bag stands up on one end as shown in FIG. 2*b*.

FIG. 2*a* shows the crease 176 that was formed by the tucker bar 106 and forming plates 104 to create a gusset 180 base bounded by an edge that permits the package to stand upright. Various modifications of the vertical stand up pouch, methods for making the pouch, and apparatuses for making the pouch are disclosed in U.S. Pat. Nos. 6,729,109 and 6,679,034.

Referring back to FIG. 1, after the transverse seal is formed by the pair of sealing jaws 126, an open-ended tube is created. The open-ended tube is pulled downward by drive belts 120, product is dropped into the open-ended tube and the bag is formed upon completion of the second end seal 133. Unfortunately, the weight of the product dropping into the open-ended tube can apply pressure to the gusset portion 180 of the open-ended tube and can cause the flexible film tube to twist or rotate below the fill tube about the fill tube axis. If the flexible film tube is twisted when the sealing jaws 126 are brought together to make the end seals 131 133, the gusset 180 can be sealed at the ends at the location indicated by numeral 141 and 143, thus forming a pleat 151 153. Pleats 151 153 are undesirable for several reasons.

FIG. 2*c* is a perspective view of a vertical stand up package having pleats. There are several problems associated with pleats. First, as shown by the Figure, a pleat can cause edge erosion. Edge erosion can inhibit the ability of the vertical stand up package to stand upon the gusset 180. Second, bags having pleats can have higher propensity to produce a non-hermetic seal and result in reduced shelf life. This can be especially true if pleats are in unpredictable or inconsistent locations. Third, pleats can interfere with easy opening features of a bag. For example, to provide an easy opening feature, a cut out 155 156 can be provided on the end seals 131 133 in communication with a score line 152 placed on the container by methods known in the art. Normally, upon tearing in the vicinity of the cut out 155 156, the film will continue to tear along the score line 152. The cut out 156, however, can be sealed by a pleat 141, preventing initiation of a tear along the score line 152. Consequently, a need exists for a vertical stand-up package having no pleats. The method and apparatus should be economical and should permit modification to existing vertical form, fill, and seal machines. In addition, the method and apparatus should minimize the breakage of frangible product within the package.

SUMMARY OF THE INVENTION

The proposed invention involves producing a vertical stand up package having a gusset and no pleats at the end seals using a vertical form, fill, and seal machine modified with a clamping mechanism. A first end seal is made in a flexible film to form an open ended tube. The open ended tube is pulled downward and a gusset is formed. The open ended tube is held in place by a clamping mechanism and product is added to the open ended tube. A second end is then made to form a bag having no pleats.

The method works on existing vertical form, fill, and seal machines requiring very little modification. The same metalized or clear laminations used as materials in pillow pouches can also be used with the invention. The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 3:
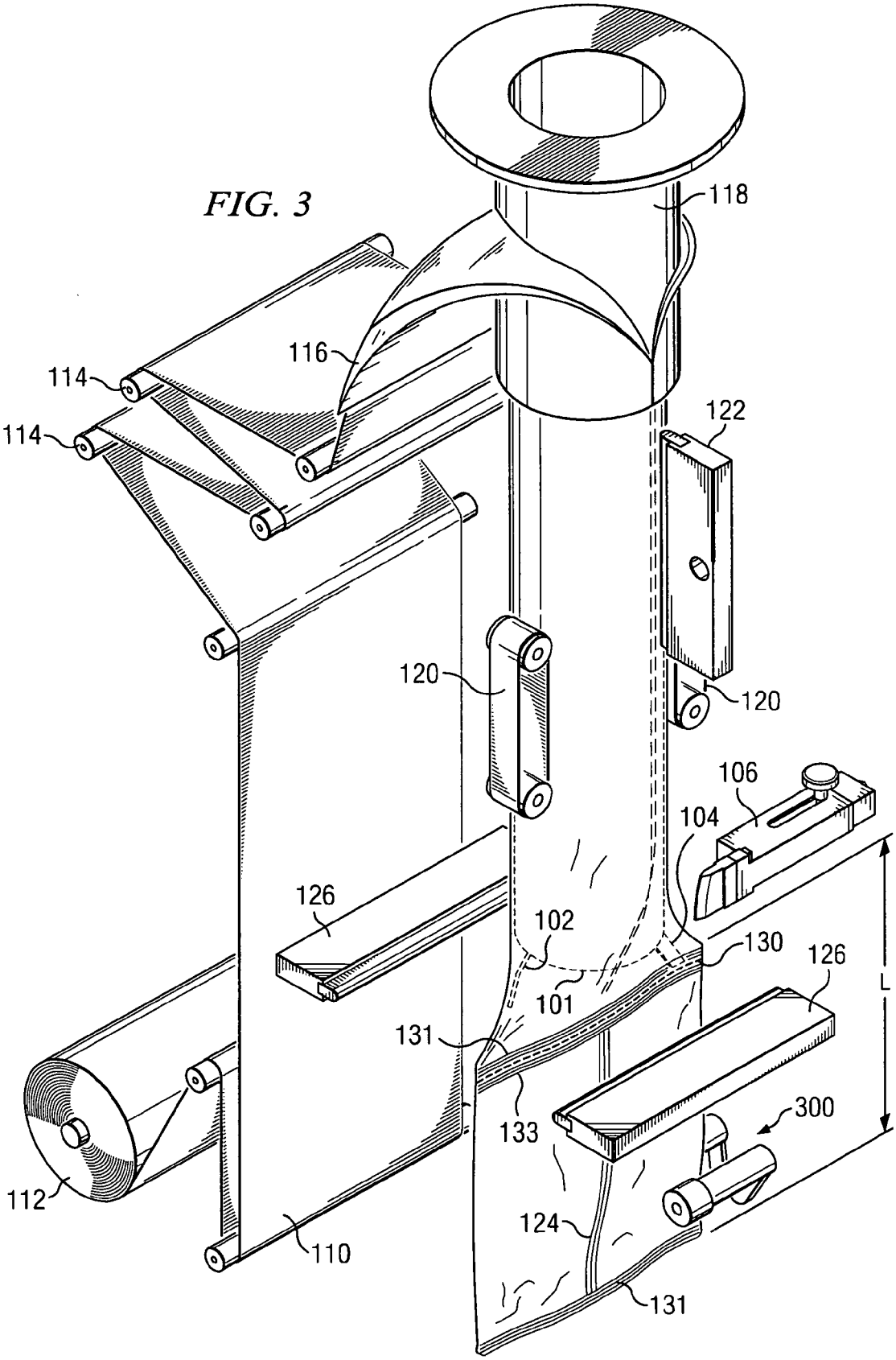
FIG. 3 is a perspective view of a vertical form, fill, and seal machine according to one embodiment of the present invention.

An embodiment of the innovative invention will now be described with reference to FIG. 3. FIG. 3 is a perspective view of a vertical form, fill, and seal machine according to one embodiment of the present invention. As shown, a bag straightening device 300 is placed on the gusset side of the open-ended tube below the sealing jaws 126. Prior to this invention, larger bags, especially those having an end seal length L greater than about 10 inches could not be efficiently used for a vertical stand up pouch because of pleating that occurred during end seal formation performed by the sealing jaws 126.

The sealing jaws 126 provide three functions simultaneously. First, they make a bottom transverse seal 131 to form an open ended tube above the sealing jaws 126. Second, they form a top transverse seal 133 to close the open-ended tube and thereby from a closed package below the sealing jaws 126. Third, they provide a cut 130 between the top transverse seal 133 of the closed package below the sealing jaws 126 and a bottom transverse seal 131 to an open ended tube above the sealing jaws 126.

Figure 1:
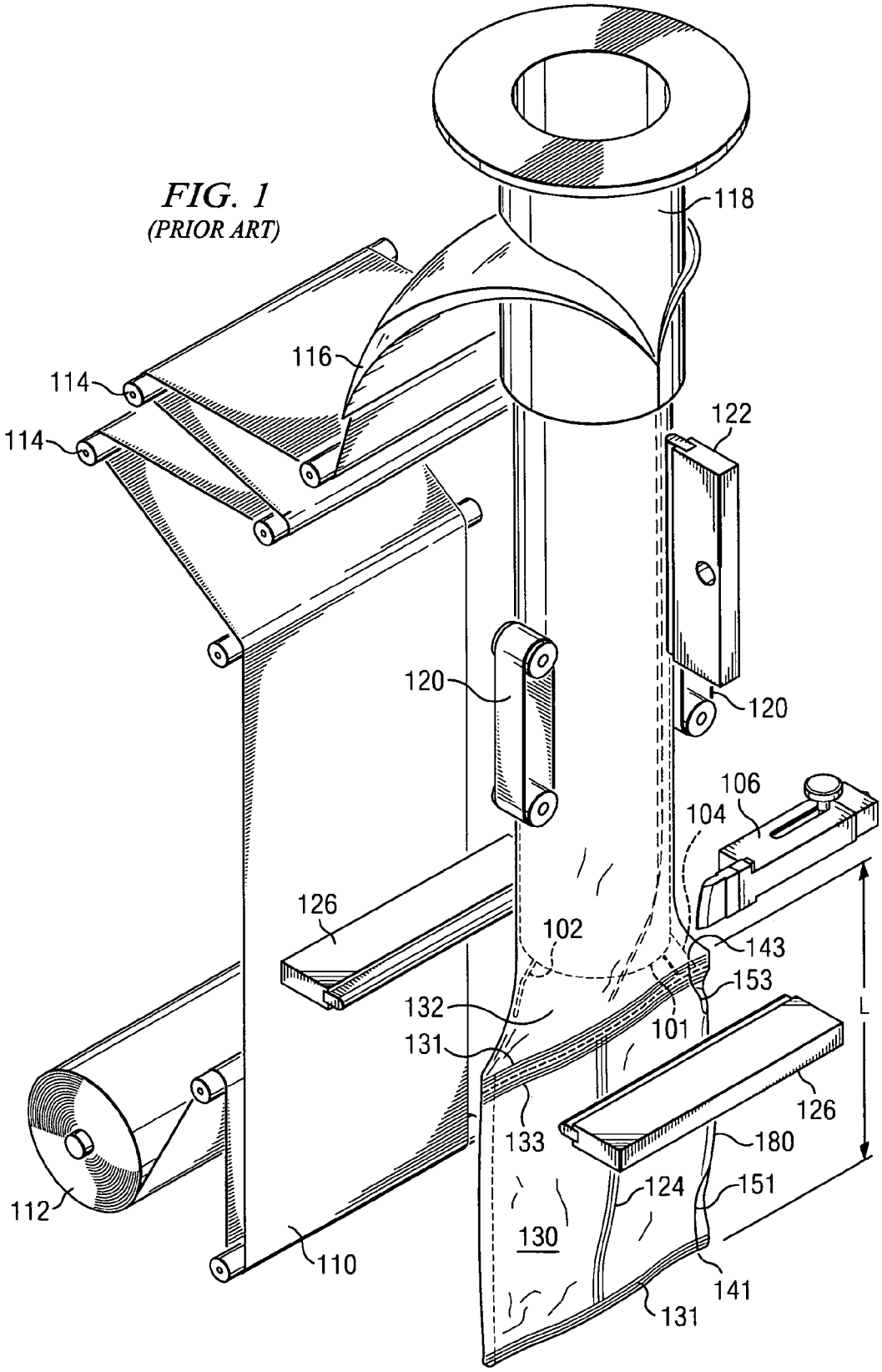
FIG. 1 (PRIOR ART)
FIG. 1 is a perspective view of a prior art form, fill, and seal machine.
Figure 2A:
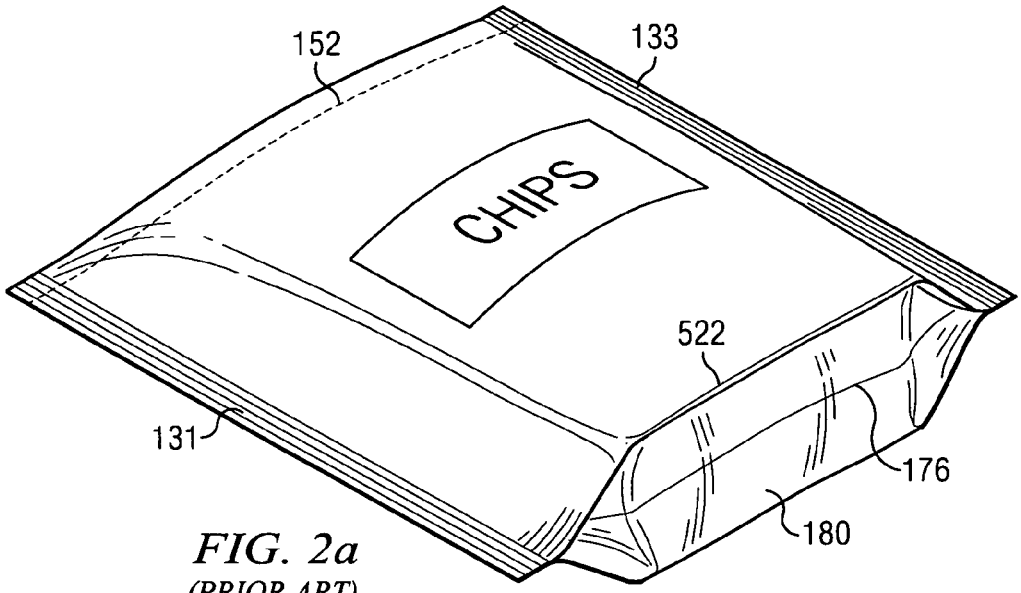
FIG. 2a (PRIOR ART)
FIGS. 2*a*, 2*b* and 2*c* are perspective views of prior art vertical stand up packages.
Figure 2B:
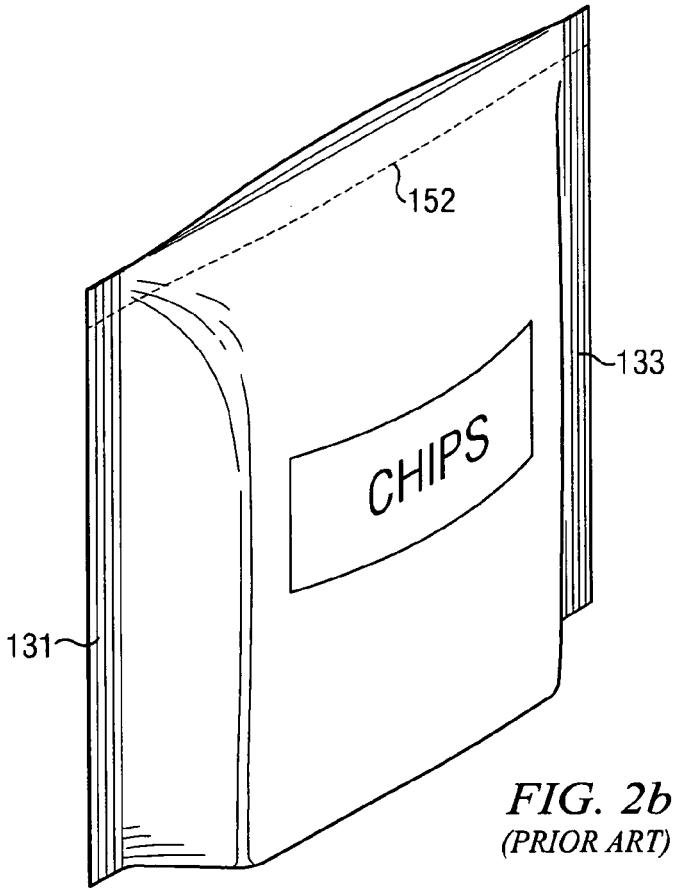
FIG. 2b (PRIOR ART)
Figure 2C:
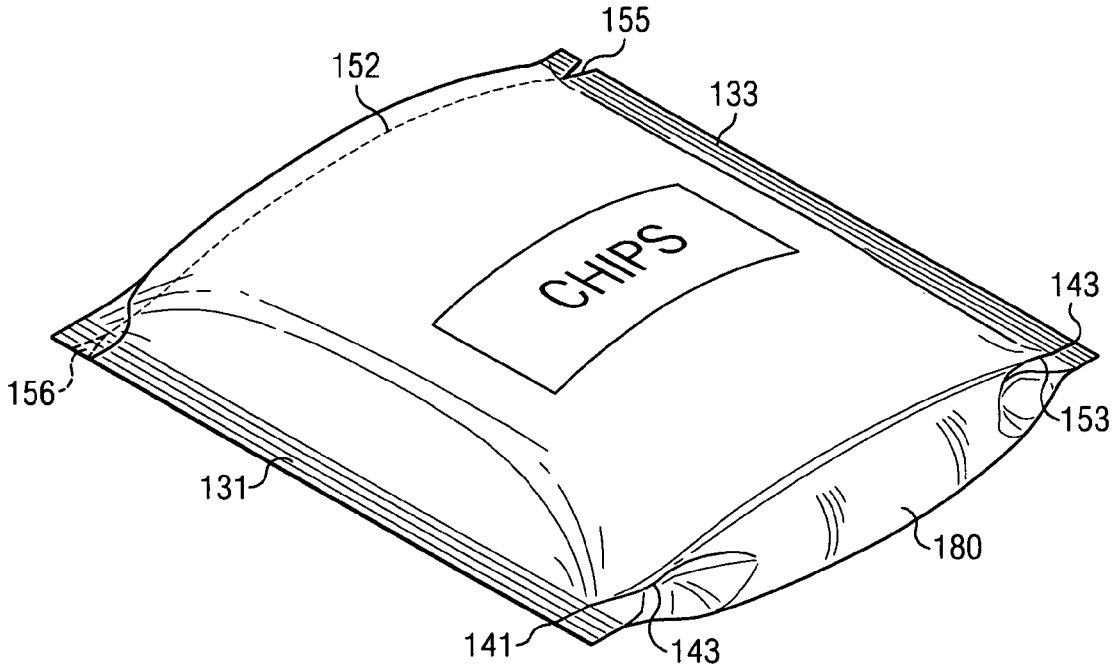
FIG. 2c (PRIOR ART)

Once the sealing jaws 126 have provided a bottom end seal 131 to form an open ended tube, the open ended tube is pulled downward by drive belts 120 or other means. A bag straightening device 300 then engages the open-ended tube. The purpose of the bag straightening device 300 is to prevent the open-ended tube from twisting or rotating below the fill tube about the fill tube axis prior to transverse seal 131 133 formation. It should be noted that the undesirable rotation occurs when the weight of the product placed into the bag exceeds a certain threshold. The product density of tortilla chips and potato chips causes this threshold to be exceeded when the end seal length L greater than about 10 inches, however, other products may cause this threshold to be exceeded at other lengths. Prevention of such rotation reduces or eliminates pleats and promotes a substantially symmetrical gusset 180 about the crease line 176, depicted in FIG. 2*a*. A substantially symmetrical gusset 180 lessens gusset variation and aids package stability.

Figure 4B:
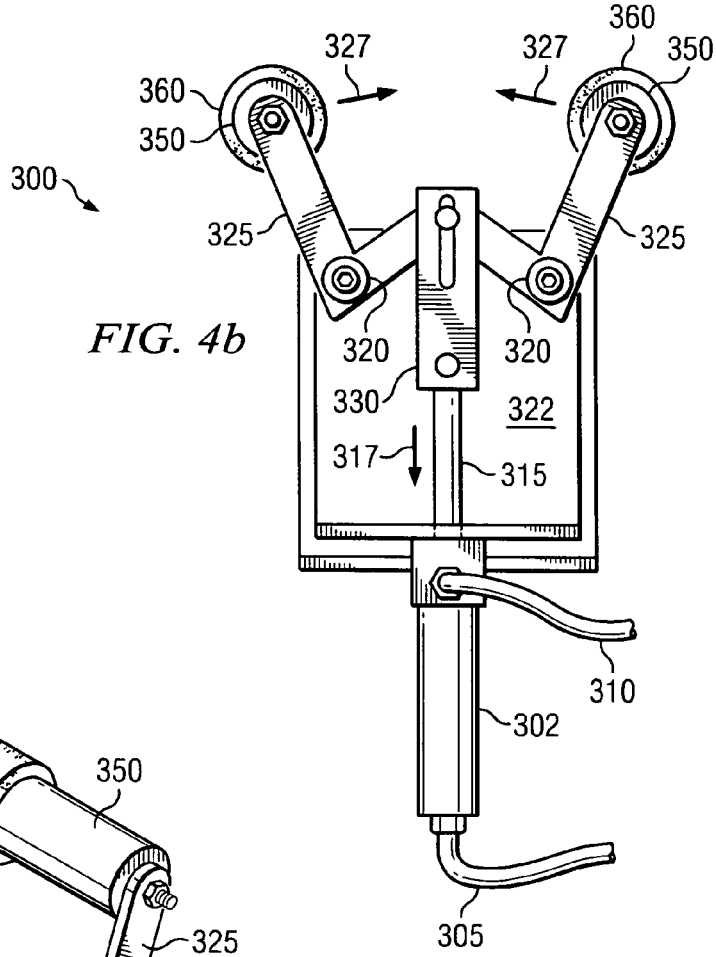
FIG. 4*b* is a side view of a bag straightening device depicted in FIG. 4*a*.
Figure 4A:
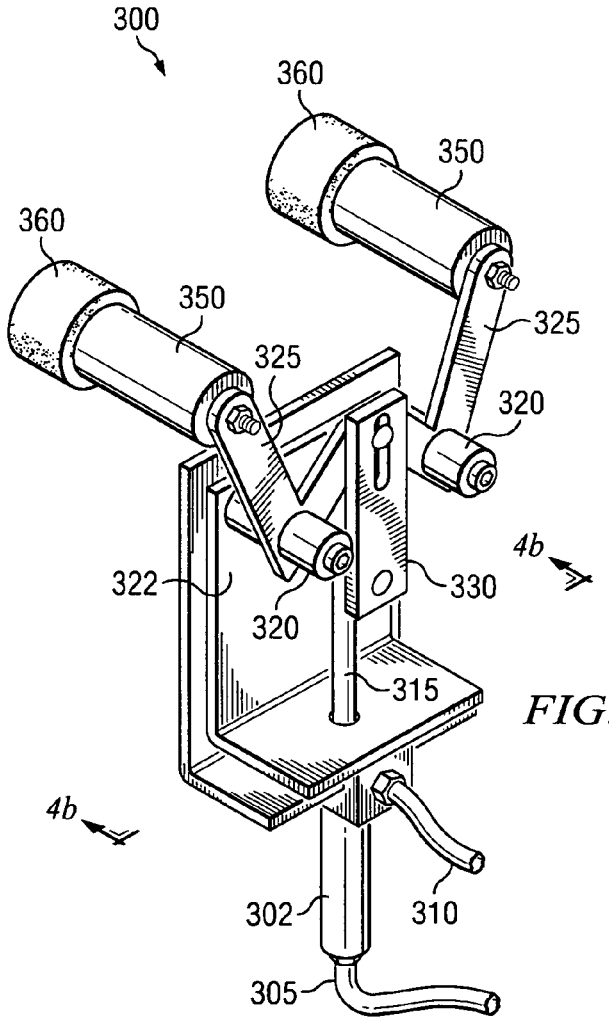
FIG. 4*a* is a perspective view of a bag straightening device in accordance with one embodiment of the present invention.

FIG. 4*a* is a perspective view of a bag straightening device 300 in accordance with one embodiment of the present invention. FIG. 4*b* is side view of a bag straightening device 300 depicted in FIG. 4*a*. Referring to FIGS. 3, 4*a*, and 4*b*, once the open-ended tube has reached its pre-determined fill position, two opposing supports 350 close to provide a clamp that prevents twisting or open tube rotation when product is subsequently dropped through the fill tube 118 into the open tube made of flexible film. After product has dropped into the open tube, the sealing jaws 126 close to form the top end seal 133 of the closed package and the bottom end seal 131 of the open tube. Because of the clamp provided by the clamping device 300, open tube rotation is prevented during the filling and sealing steps. Further, because the sealing jaws 126 simultaneously provide the bottom seal 131 of the open tube at the same time it provides the top seal 133 of the closed package, the clamp prevents pleating at both seals 131 133. Thus, a vertical stand up package having a substantially symmetrical gusset is made with no pleats. The clamp then disengages the closed package and the process repeats.

In one embodiment, the clamp is provided at least one inch above the first end seal. In one embodiment, the clamp location height can be easily adjusted by manipulation of a screw (not shown) to vary the distance of the clamping device support member 322 in relation to the sealing jaws 126.

In one embodiment, the bag straightening device 300 shown is pneumatically operated. Thus, compressed air can be used to actuate a clamping mechanism. In alternative embodiments, the bag straightening device can be hydraulically or electrically operated. In one embodiment, the clamping mechanism comprises a piston 315 mounted to a pair of arms 325. Each arm 325 is attached to a support 350. In one embodiment, each arm comprises an elbow 320.

To close the bag straigtening device or clamping mechanism 300, compressed air 310 causes the piston 315 to be pulled in the direction as indicated by the arrow 317. This causes the arms 325 to rotate inward about the elbows 320 causing the support 350 to reciprocate towards each other in the direction depicted by the arrows 327. In one embodiment, the actuating can be reversed such that compressed air 305 causes the piston 315 to be pulled in the direction as indicated by the arrow 317.

In one embodiment, the clamping mechanism 300 engages and holds the open-ended tube before the tube is filled with product. This can help to minimize gusset variation that may occur if product is first placed into the open-ended tube. This also helps to prevent breakage of potentially frangible product, such as potato or tortilla chips. In one embodiment, the piston 315 is attached to an adjustable member 330 such that the tension applied by the clamping mechanism 300 can be adjusted.

In one embodiment, the portion of the support 350 that engages the open-ended tube comprises a resilient material 360. Once the open-ended tube is filled with product, the end seals 131 133 are created before the clamping mechanism disengages.

To open the clamping mechanism, compressed air 305 causes the piston to be pushed upward. The arms 325 rotate outward about the elbows 320 causing the supports 350 to reciprocate away from each other. The above embodiment is just one example of a bag straightening device.

The present invention can be achieved with relatively inexpensive modification of existing form, fill, and seal machinery to produce a relatively large vertical stand up package with minimal pleating and a substantially symmetrical gusset. In one embodiment, the gusset width is greater than about 3 inches. As used herein, the gusset width is the length of film from the substantially parallel edges of the gusset and is perpendicular to the crease line 176. (The non-parallel edges of the gusset are located near the end seals.) The gusset length is the distance from end seal 131 to end seal 133.

While the invention has been particularly shown and described with reference to a preferred embodiment, it will be understood by those skilled in the art that various changes in form and detail may be made therein without departing from the spirit and scope of the invention. For example, shapes other than a circular shape as defined by a support 350 can be used in the clamping mechanism.

What is claimed is:

1. A method for making a vertical stand-up pouch having a gusset having no pleats at the end seals and a substantially symmetrical gusset, said method comprising the sequential steps of:

a) forming a first end seal with a pair of sealing jaws to form an open ended tube; then b) pulling said open ended tube downward and forming a gusset; then c) engaging said open ended tube with a clamping mechanism; then d) filling said open ended tube with product; and then e) forming a second end seal to seal said open ended tube to form a bag having no pleats, wherein steps a) through e) occur on a vertical form fill and seal machine.

2. The method of claim 1 further comprising the step of:

f) dis-engaging said clamping mechanism from said bag.

3. The method in claim 1 wherein an end seal length between said first end seal at step a) and said second end seal at step e) is greater than 9 inches.

4. The method in claim 1 wherein said clamping mechanism at step c) is pneumatically operated, electrically operated, or hydraulically operated.

5. The method in claim 1 wherein said clamping mechanism comprises a resilient material.

6. The method in claim 1 wherein said gusset width is greater than 3 inches.

7. The method in claim 1 wherein said engaging at step c) occurs at least one inch above said first end seal.

* * * * *